United States Patent [19]

Kawabata

[11] Patent Number: 4,581,310

[45] Date of Patent: Apr. 8, 1986

[54] METHOD OF FORMING PLURAL COPIES

[75] Inventor: Hidetoshi Kawabata, Toyohashi, Japan

[73] Assignee: Minolta Camera Kabushiki Kaisha, Osaka, Japan

[21] Appl. No.: 644,103

[22] Filed: Aug. 24, 1984

[30] Foreign Application Priority Data

Sep. 2, 1983 [JP] Japan ..... 58-162330

[51] Int. Cl.[4] ..... G03G 13/16; G03G 13/22

[52] U.S. Cl. ..... 430/54; 430/126

[58] Field of Search ..... 430/126, 54, 100

[56] References Cited

U.S. PATENT DOCUMENTS 3,888,664 6/1975 Carlson et al. ..... 430/126
4,256,820 3/1981 Landa ..... 430/54
4,297,423 10/1981 Nishikawa ..... 430/126

FOREIGN PATENT DOCUMENTS 56-168663 12/1981 Japan .

*Primary Examiner*—John L. Goodrow
*Attorney, Agent, or Firm*—Wenderoth, Lind & Ponack

[57] ABSTRACT

The present invention concerns with a method of forming plural copies. The method is constituted by:

the first step of charging a photosensitive member, the second step of exposing the charged photosensitive member to an optical image to form an electrostatic latent image, the third step of developing the latent image with a toner, the fourth step of charging the photosensitive member to invert the toner polarity of the developed image, the fifth step of illuminating the photosensitive member charged by the fourth step with light to form the same electrostatic latent image as the latent image formed by the second step, the sixth step of transferring the developed image to copy paper, and the step of repeating the third step to the sixth step.

3 Claims, 2 Drawing Figures

METHOD OF FORMING PLURAL COPIES

BACKGROUND OF THE INVENTION

1. Field of the Invention

The present invention relates to a method of continually forming plural copies from a single electrostatic latent image.

2. Prior Art

A method of making plural copies is known which comprises, for example, forming an electrostatic latent image on a photosensitive member, developing the latent image, transferring the developed image to paper and thereafter repeating the developing and transferring steps only for forming the second and following copies. Although having the advantage of being simple, this method has the following drawbacks. Because the electrostatic latent image once formed must be retained over a prolonged period of time, there is the need to use a photosensitive member having excellent dark decay characteristics. This limits not only the type of photosensitive members that can be used but also the number of copies which can be made continually. Even when the photosensitive member used has outstanding dark decay characteristics, there arises the necessity of varying the developing bias voltage or transfer bias voltage with an increasing number of copies in order to maintain the initial high density.

Published Unexamined Japanese Patent Application SHO No. 56-168663 discloses another method of making plural copies wherein an amorphous silicon photosensitive member is used for forming an electrostatic latent image, which is developed and then semi-fixed by heating. The photosensitive member bearing the semi-fixed image is charged, exposed to light and developed to obtain a developed image, which is subsequently transferred onto copy paper. The charging, exposing, developing and tranferring steps are thereafter repeated for making the second and following copies. With this method wherein the image formed on the photosensitive member needs to be semi-fixed, the photosensitive member must have high heat resistance, and the photosensitive member is susceptible to damage when the semi-fixed image is removed from the member after making the desired number of copies.

SUMMARY OF THE INVENTION

The main object of the present invention is to provide a method of forming plural copies wherein a desired photosensitive member is usable and which is adapted for continually making an increased number of copies with images of good quality by simplified steps under easily settable conditions.

Another object of the invention is to provide a method of forming plural copies which is greatly simplified and which is adapted to make a multiplicity of copies rapidly and which is free of the above conventional drawbacks.

These and other objects of the invention can be fulfilled by a method of forming plural copies which comprises:

the first step of charging a photosensitive member, the second step of exposing the charged photosensitive member to an optical image to form an electrostatic latent image, the third step of developing the latent image with a toner, the fourth step of charging the photosensitive member to invert the toner polarity of the developed image, the fifth step of illuminating the photosensitive member charged by the fourth step with light to form the same electrostatic latent image as the latent image formed by the second step, the sixth step of transferring the developed image to copy paper, and the step of repeating the third step to the sixth step.

DETAILED DESCRIPTION OF THE INVENTION

Figure 1:
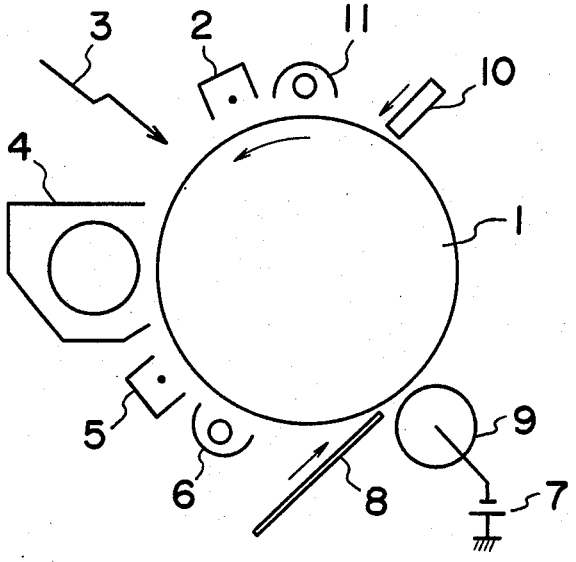
FIG. 1 is a diagram schematically showing the construction of a copying machine for practicing a method of the invention for forming plural copies.
Figure 2A:
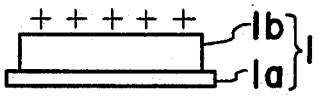
FIG. 2 (*a*) to FIG. 2 (*g*) are diagrams showing the steps of the method of the invention.
Figure 2B:
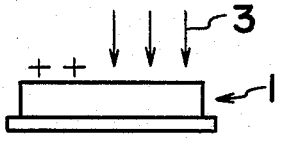
Figure 2C:
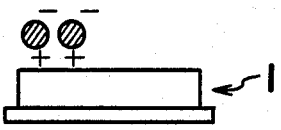
Figure 2D:
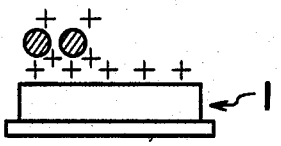
Figure 2E:
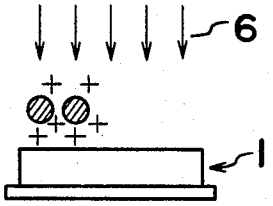
Figure 2F:
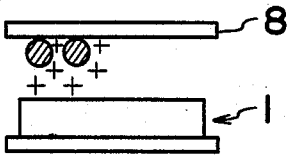
Figure 2G:
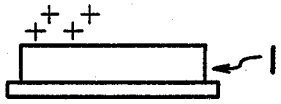

FIG. 1 schematically shows the construction of a copying machine for practicing the method of the present invention for forming plural copies. Indicated at 1 is a photosensitive drum which is rotatable counterclockwise. Arranged around the drum 1 are a main corona charger 2 for uniformly charging the drum 1, an exposure station 3 for continuously exposing the drum surface to the image of an original, a magnetic brush developing unit 4 for developing the electrostatic latent image formed on the drum surface, an inverting corona charger 5 for inverting the toner polarity of the developed image, an illuminating lamp 6 for illuminating the drum 1 with light, a transfer roller 9 connected to a d.c. bias voltage source 7 for transferring the developed image onto copy paper 8, a blade cleaner 10 for removing residual toner, and an eraser lamp 11 for erasing residual charges.

The copying machine of the above construction practices the present method by the following steps as shown in FIGS. 2 (*a*) to 2 (*g*).

The photosensitive drum 1 comprises an electrically conductive substrate 1*a* and a photoconductive layer 1*b* formed over the substrate. In the first step, the drum 1 is uniformly charged by the main corona charger 2 to a predetermined surface potential of specified polarity, e.g. positive polarity as seen in FIG. 2 (*a*). For the present method, photosensitive members of almost any type are usable which include, for example, those prepared by coating an electrically conductive substrate with Se or Se alloy by vacuum evaporation, or by coating such a substrate with a dispersion of ZnO, CdS, $CdS.nCdCO_3$, phthalocyanine or the like in a binder resin. Also usable is a photosensitive member having a three-layer structure adapted for separately effecting charge generation and transport.

In the second step, the photosensitive drum 1 is exposed to an optical image at the exposure station 3 to form an electrostatic latent image on the drum surface as shown in FIG. 2 (*b*). The charges on the exposed area are attenuated, while the charges on the nonexposed area remain unaffected.

The electrostatic latent image formed by the second step is developed in the third step by the magnetic brush developing unit 4. A toner of negative polarity is deposited on the image area of the latent image in corresponding relation to the positive charges forming the image area as shown in FIG. 2 (*c*). The developer may be composed of one or two components, and the image can be developed also by known processes other than the magnetic brush process.

In the subsequent fourth step, the inverting corona charger 5 charges the photosensitive drum 1 to the same polarity as the latent image, thereby charging the drum surface to a predetermined potential and inverting the polarity of the toner. Thus, the drum surface is charged to the predetermined potential and the toner polarity is inverted to the positive as shown in FIG. 2 (*d*). The charge potential, although dependent on the type of photosensitive drum used, must be such that the drum retains a sufficient potential when it is subjected to development again by the developing unit 4 after rotating approximately one turn. In other words, the inverting corona charger 5 is set to give a high charge potential so as to assure a potential sufficient to form a satisfactory image for development even when the charges provided by the inverting corona charger 5 undergo dark decay before the development by the unit 4. Accordingly the charge potential to be given by the inverting corona charger 5 is determined by the dark decay characteristics of the photosensitive drum used and the developing potential of the developing unit.

In the fifth step, the photosensitive drum 1 thus charged by the inverting corona charger 5 is illuminated with light by the illuminating lamp 6 to form the same electrostatic latent image as the latent image formed by the second step as shown in FIG. 2 (*e*). More specifically, the charges on the area of the drum surface bearing no toner are attenuated by the illumination, whereas the light which would otherwise be incident on the toner bearing surface area is blocked by the toner, permitting the surface area to retain the charges as formed thereon, with the result that the same electrostatic latent image as formed in the second step is formed.

In the sixth step, the developed image is transferred to copy paper 8 by the transfer roller 9 as seen in FIG. 2 (*f*). To transfer the image, the d.c. bias voltage source 7 applies to the transfer roller a bias voltage of a polarity opposite to the polarity of the toner inverted by the fourth step. Instead of using the transfer roller as above, the image may be transferred by pressure or a usual corona charger. When the corona charger is used, the polarity of transfer charges is opposite to the polarity of the toner inverted in the fourth step and to the polarity of the latent image formed in the fifth step, so that even if the latent image is charged through the copy paper 8, the result is merely such that the image area thereof has its potential reduced with the nonimage area somewhat charged negatively. Accordingly no problem arises as long as the charge potential given by the inverting corona charger 5 in the fourth step is at a sufficiently high level. Thus, whatever transfer means is used, the electrostatic latent image shown in FIG. 2 (*g*) remains on the photosensitive drum 1 after the image transfer.

In this way, the first copy image is transferred to the paper 8, which is then separated from the photosensitive drum 1 and has the toner image fixed thereto by an unillustrated fixing unit. On the other hand, the blade cleaner 10 scrapes the residual toner off the drum 1 after the transfer. It is desired that the blade cleaner be one made of an insulating material so as not to destroy the electrostatic latent image formed on the drum. The residual toner need not always be removed by the blade cleaner at this time; the blade cleaner may be made movable into or out of contact with the drum to clean the drum only after the completion of the final copying cycle. In this case, the blade may be of an electrically conductive material.

The image bearing portion of the drum 1 subsequently passes immediately below the eraser lamp 11 which is held out of operation at this time. The drum comes into the second turn of rotation, with the main corona charger 2 and the image projecting exposure system held out of operation. Next, the latent image formed in the fifth step and shown in FIG. 2 (*f*) is developed by the magnetic brush developing unit 4 in the same manner as in the third step. Subsequently the drum is charged by the inverting corona charger 5 and illuminated by the lamp 6, and the image is transferred by the transfer roller 9 to give the second copy. In other words, n copies ($n \geqq 2$) can be made by performing the first to sixth steps for the first copy and repeating the third to sixth steps the required number of times only for the second and following copies. After the transfer for making the last copy has been completed, the residual toner is removed from the drum 1 by the blade cleaner 10, and the residual charges are removed by the eraser lamp 11 in preparation for the next operation for forming plural copies.

With reference to FIG. 1, the eraser lamp 11 may be omitted and the illuminating lamp 6 used to erase the residual charges. In this case, the illuminating lamp 6 is adapted to emit light with two different intensities, such that the drum is exposed to light of low intensity in the fifth step of illumination and to light of high intensity for erasing the residual charges, whereby the memory phenomenon of the drum can be prevented effectively. Further in the fifth step, the lamp 6 needs to illuminate the drum from immediately above the toner deposited thereon so as not to erase the charges beneath the toner. Further the fourth and fifth steps may be performed at the same time. In this case, an opening is formed in the top portion of the shield for the inverting corona charger 5 to project light through the opening simultaneously with charging.

EXAMPLE

For an image forming experiment, a multiplicity of copies were made continually with use of a copying machine of the construction shown in FIG. 1. The photosensitive drum 1 used was one prepared by coating an aluminum drum with a dispersion of photoconductive powder of $CdS.nCdCO_3$ in a binder resin to a thickness of about 30 microns and covering the photoconductive layer with a light-transmitting insulating protective layer of up to 0.1 micron in thickness. The drum 1 was first charged to −550 V by the main corona charger 2 and then exposed to an optical image at 11 lux.sec to form an electrostatic latent image. The latent image was developed by the magnetic brush developing unit 4 with the two-component developer disclosed in Published Unexamined Japanese Patent Application SHO No. 55-32073. Subsequently the drum 1 was charged to a surface potential of −750 V by the inverting corona charger 5 and then exposed to light at 8 to 12 lux·sec by the illuminating lamp 6. The developed image was thereafter transferred onto paper to obtain a first copy by applying a bias voltage of +800 V from the bias voltage source 7 to the transfer roller 9 which was an electrically conductive roller having a resistivity of $5 \times 10^8$ ohm-cm. The second and other copies were made by repeating only the development with the developing unit 4, charging with the inverting corona charger 5, exposure with the illuminating lamp 6 and transfer with the transfer roller 9 under the same conditions as above. Consequently images having excellent quality and also having excellent halftone were obtained for the first 20 copies or so. When the above image forming experiment was repeated with use of a black-and-white halftone image as the original, no reduction in the quality of copy images was observed for more than 100 copies.

As will be apparent from the foregoing description, a photosensitive member of a desired type is usable for the copying method of this invention to continually produce a multiplicity of copies with satisfactory images by a simplified process which is easily controllable. More specifically, an electrostatic latent image is formed repeatedly based on the latent image first formed without the necessity of exposing the drum to the original image for every copy, so that the present invention affords satisfactory copy images with high density at all times without the need to use a photosensitive member of excellent dark decay characteristics. As compared with conventional transfer-type copying machines, only a corona charger and an illuminating lamp are additionally required for the apparatus for practicing the present method.

What is claimed is:

1. A method of forming plural copies which comprises:

a first step of charging a photosensitive member with a first polarity;

a second step of exposing the charged photosensitive member to an optical image to form an electrostatic latent image;

a third step of developing said latent image with a toner;

a fourth step of charging the photosensitive member with the first polarity to invert the toner polarity of the developed image;

a fifth step of illuminating the photosensitive member;

a sixth step of transferring the developed image to copy paper; and repeating said third to sixth steps.

2. A method of forming plural copies which comprises:

a first step of charging a photosensitive member with a first polarity;

a second step of exposing the charged photosensitive member to an optical image to form an electrostatic latent image;

a third step of developing said latent image with a toner of second polarity;

a fourth step of charging the photosensitive member with the first polarity to invert the toner polarity of the developed image;

a fifth step of illuminating the photosensitive member with light to form the same electrostatic latent image;

a sixth step of transferring the developed image to copy paper to form a first copy; and repeating said third to said sixth step to form second and subsequent copies.

3. A method of forming plural copies which comprises in the recited order:

a first step of charging a photosensitive member with a first polarity;

a second step of exposing the charged photosensitive member to an optical image to form an electrostatic latent image;

a third step of developing said latent image with a toner of second polarity;

a fourth step of charging the photosensitive member with the first polarity to invert the toner polarity of the developed image;

a fifth step of illuminating the photosensitive member charged by the fourth step with light to form the same electrostatic latent image as the latent image formed by the second step;

a sixth step of transferring the developed image to copy paper to form a first copy; and repeating said third to said sixth step to form second and subsequent copies.

* * * * *